US011435104B2

(12) United States Patent
Cha

(10) Patent No.: US 11,435,104 B2
(45) Date of Patent: Sep. 6, 2022

(54) HOME APPLIANCE AND CONTROL METHOD FOR CONTROLLING SAME

(71) Applicant: Samsung Electronics Co., Ltd., Suwon-si (KR)

(72) Inventor: Jaehoon Cha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/770,822

(22) PCT Filed: Nov. 29, 2018

(86) PCT No.: PCT/KR2018/014909

§ 371 (c)(1),
(2) Date: Jun. 8, 2020

(87) PCT Pub. No.: WO2019/124800

PCT Pub. Date: Jun. 27, 2019

(65) Prior Publication Data

US 2021/0180821 A1 Jun. 17, 2021

(30) Foreign Application Priority Data

Dec. 22, 2017 (KR) ..... 10-2017-0178059

(51) Int. Cl.

| | |
|---|---|
| ***F24F 11/50*** | (2018.01) |
| ***F24F 8/192*** | (2021.01) |
| ***F24F 11/30*** | (2018.01) |

(52) U.S. Cl.

CPC ..... *F24F 11/50* (2018.01); *F24F 8/192* (2021.01); *F24F 11/30* (2018.01)

(58) Field of Classification Search

CPC . F24F 11/50; F24F 11/30; F24F 8/192; H04Q 9/04; H04Q 2209/43; H04Q 2209/80

See application file for complete search history.

(56) References Cited

U.S. PATENT DOCUMENTS 7,984,117 B2 7/2011 Yook et al.
9,091,451 B2 7/2015 Hansen et al.
(Continued)

FOREIGN PATENT DOCUMENTS

CN 1459958 A 12/2003
CN 104282067 A 1/2015
(Continued)

OTHER PUBLICATIONS

Extended European Search Report dated Nov. 20, 2020, issued in European Patent Patent Application No. 18891507.8-1215.
(Continued)

*Primary Examiner* — Charles R Kasenge
(74) *Attorney, Agent, or Firm* — Jefferson IP Law, LLP

(57) ABSTRACT

A home appliance is disclosed. The home appliance comprises: a communication unit; and a processor for receiving a signal including identification information of external home appliances from at least one external home appliance through the communication unit for a preset amount of time, identifying an external home appliance arranged adjacently to the home appliance on the basis of the received signal, and performing a communication connection with the identified external home appliance, when an event for the communication connection with the at least one external home appliance occurs.

13 Claims, 8 Drawing Sheets

(56) References Cited

U.S. PATENT DOCUMENTS

| | | | | |
|---|---|---|---|---|
| 9,240,700 | B2 | 1/2016 | Terlizzi et al. | |
| 9,562,702 | B2 | 2/2017 | Law et al. | |
| 9,667,070 | B2 | 5/2017 | Lee et al. | |
| 2004/0047298 | A1 | 3/2004 | Yook et al. | |
| 2010/0307178 | A1 | 12/2010 | Hansen et al. | |
| 2015/0306533 | A1* | 10/2015 | Matlin | B01D 46/448 96/420 |
| 2016/0061468 | A1 | 3/2016 | Alexander et al. | |
| 2016/0073197 | A1* | 3/2016 | Hammer | H04R 5/02 381/80 |
| 2017/0138615 | A1 | 5/2017 | Liang et al. | |
| 2017/0163437 | A1 | 6/2017 | Yang et al. | |

FOREIGN PATENT DOCUMENTS

| | | | |
|---|---|---|---|
| CN | 105278498 | A | 1/2016 |
| EP | 2 166 293 | A2 | 3/2010 |
| JP | 3176710 | U | 7/2012 |
| KR | 10-2005-0087976 | A | 9/2005 |
| KR | 10-2006-0026319 | A | 3/2006 |
| KR | 10-2010-0032796 | A | 3/2010 |
| KR | 10-2012-0082827 | A | 7/2012 |
| KR | 10-2012-0122233 | A | 11/2012 |
| KR | 10-1528466 | B1 | 6/2015 |
| KR | 10-2016-0027395 | A | 3/2016 |
| KR | 10-1644280 | B1 | 7/2016 |
| KR | 10-1677766 | B1 | 11/2016 |
| KR | 10-2017-0041663 | A | 4/2017 |

OTHER PUBLICATIONS

Chinese Office Action with English translation dated Dec. 24, 2021; Chinese Appln. No. 201880083002.8.

* cited by examiner

HOME APPLIANCE AND CONTROL METHOD FOR CONTROLLING SAME

TECHNICAL FIELD

This disclosure relates to a home appliance and a method for controlling the same, and more particularly relates to a modular home appliance and a method for controlling the same.

BACKGROUND ART

A modular home appliance is a device attachable to or detachable from another home appliance. It is advantageous in terms of utilizing the space, when modular home appliances are arranged in a stacked form. For example, if two modular air purifiers are arranged in a stacked form, the planar space taken by the two air purifiers may be reduced, compared to a case where the two modular air purifiers are separately arranged in a living room.

However, the conventional modular home appliances executed functions independently, even though the modular home appliances were attached to each other. That is, there is inconvenience for a user to separately input user commands to each of a plurality of home appliances in order to control the plurality of modular home appliances attached to each other.

DISCLOSURE

Technical Problem

The disclosure is made in view of such needs and an object of the disclosure is to provide a home appliance connected for communication to stacked modular home appliances and collectively controlled and a method for controlling the same.

Technical Solution

According to an embodiment of the disclosure for achieving the aforementioned object, there is provided a home appliance including a communicator including circuitry, and a processor configured to, based on an event for communication connection to at least one external home appliance occurring, receive a signal including identification information of the at least one external home appliance from the external home appliance via the communicator for a predetermined period of time, identify an external home appliance arranged adjacent to the home appliance based on the received signal, and execute communication connection to the identified external home appliance.

The identification information may include type information of an external home appliance.

The processor may be configured to, based on the external home appliance being identified as the same type as the home appliance based on the type information of the external home appliance, execute the communication connection to the identified external home appliance based on the identification information.

The processor may be configured to identify an external home appliance arranged adjacent to the home appliance in a predetermined arrangement state based on an intensity of the received signal.

The identification information may include arrangement state information of the external home appliance.

The processor may be configured to identify an external home appliance arranged adjacent to the home appliance in a predetermined arrangement state based on the arrangement state information.

The identification information may include at least one of a product name, a product number, and a MAC address, arrangement state information of the external home appliance, and type information indicating the type of the external home appliance.

The home appliance may further include a storage.

The processor may be configured to transmit pairing request signals to a plurality of external home appliances according to the event, and receive a pairing response signal including arrangement state information of each external home appliance from the plurality of external home appliances for a predetermined period of time, and store intensities of the pairing response signals and arrangement state information received form the plurality of external home appliances in the storage.

The processor may be configured to transmit pairing request signals including type information of the home appliance to the plurality of external home appliances, and receive pairing response signals including arrangement state information and type information of each external home appliance from the plurality of external home appliances.

The predetermined arrangement state may be at least one of a state arranged on an upper portion of the home appliance and a state arranged on a lower portion of the home appliance.

The processor may be configured to identify an external home appliance to be connected for communication based on an intensity of the received signal, and determine whether or not the external home appliance is in the predetermined arrangement state with respect to the home appliance based on arrangement state information of the home appliance and arrangement state information of the identified external home appliance.

The arrangement state information may be information including a top state indicating arrangement on an uppermost portion, a bottom state indicating arrangement on a lowermost portion, and a middle state indicating arrangement between the uppermost and the lowermost portions, among a plurality of stacked home appliances.

The home appliance and the external home appliance may be air purifiers.

The intensity of the received signal may be an average value of intensities of signals periodically received for the predetermined period of time.

The event for communication connection may be at least one of an event of turning on power of the home appliance and an event in which the home appliance is physically connected to at least one external home appliance.

According to another embodiment of the disclosure, there is provided a method for controlling a home appliance, including, based on an event for communication connection to at least one external home appliance occurring, receiving a signal including identification information of the at least one external home appliance from the external home appliance for a predetermined period of time, identifying an external home appliance arranged adjacent to the home appliance based on the received signal, and executing communication connection to the identified external home appliance.

The identification information may include type information of an external home appliance.

The executing communication connection may include, based on the external home appliance being identified as the same type as the home appliance based on the type information of the external home appliance, executing the communication connection to the identified external home appliance based on the identification information.

The identifying may include identifying an external home appliance arranged adjacent to the home appliance in a predetermined arrangement state based on an intensity of the received signal.

The identification information may include arrangement state information of the external home appliance, and the identifying may include identifying an external home appliance arranged adjacent to the home appliance in a predetermined arrangement state based on the arrangement state information.

The identification information may be information including at least one of a product name, a product number, and a MAC address, arrangement state information of the external home appliance, and type information indicating a type of the external home appliance.

The receiving a signal may include transmitting pairing request signals to a plurality of external home appliances according to the event, and receiving a pairing response signal including arrangement state information of each external home appliance from the plurality of external home appliances for a predetermined period of time.

The control method may further include storing intensities of the pairing response signals and arrangement state information received form the plurality of external home appliances.

The receiving signals may include transmitting pairing request signals including type information of the home appliance to the plurality of external home appliances, and receiving pairing response signals including arrangement state information and type information of each external home appliance from the plurality of external home appliances.

The predetermined arrangement state may be at least one of a state arranged on an upper portion of the home appliance and a state arranged on a lower portion of the home appliance.

The identifying may include identifying an external home appliance to be connected for communication based on an intensity of the received signal, and determining whether or not the external home appliance is in the predetermined arrangement state with respect to the home appliance based on arrangement state information of the home appliance and arrangement state information of the identified external home appliance.

Effect of Invention

As described above, according to various embodiments of the disclosure, it is possible to provide improved functions by stacking the modular home appliances, and convenience of a user is improved since a plurality of stacked home appliances are collectively controlled.

DETAILED DESCRIPTION OF EXEMPLARY EMBODIMENTS

Figure 1:
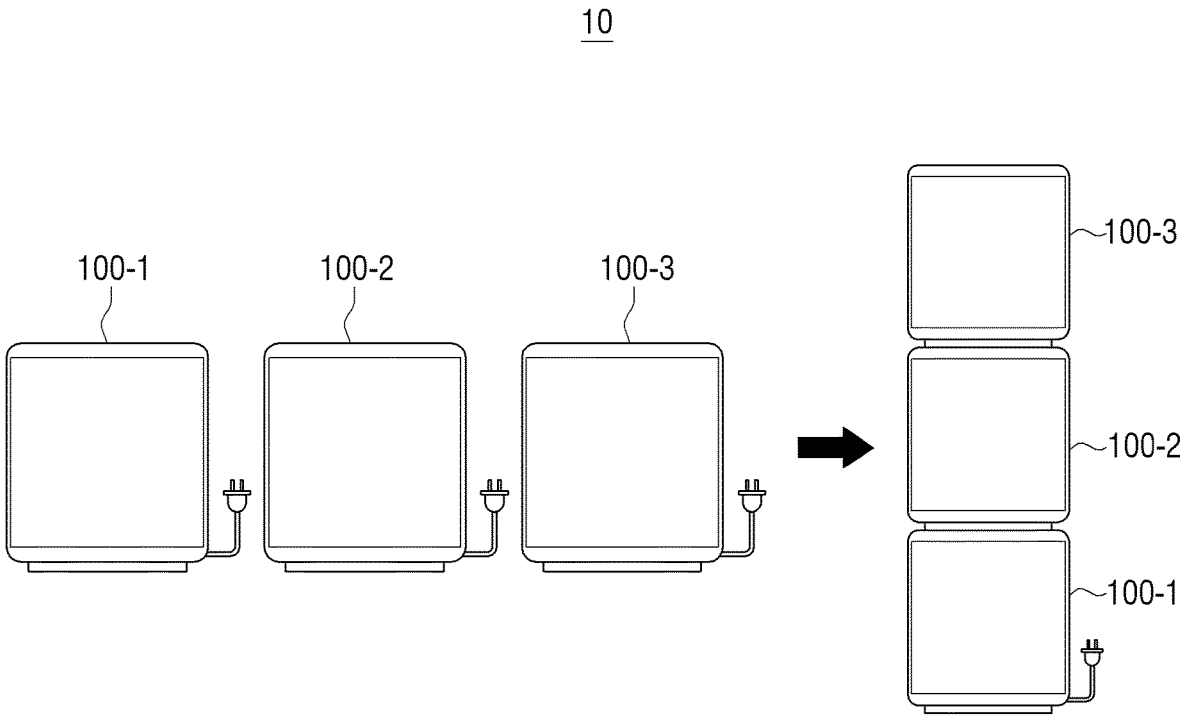
FIG. 1 is a schematic view for describing an electronic system in which modular home appliances are stacked and collectively controlled according to an embodiment.

Hereinafter, the disclosure will be described in detail with reference to the drawings. In describing the disclosure, a detailed description of the related art or the configuration is omitted when it is determined that the detailed description may unnecessarily obscure a gist of the disclosure. In addition, the embodiment below can be modified in various different forms and the scope of the technical idea of the disclosure is not limited to the embodiment below. Such embodiments are provided to complete the disclosure and to completely convey the technical idea of the disclosure to those skilled in the art.

In addition, the expression "comprising" a certain element does not mean to exclude other elements, but means to further comprise other elements, unless otherwise noted. Further, various elements and areas in the drawings are schematically shown. Thus, the technical idea of the disclosure is not limited by relative sizes or intervals shown in the accompanying drawings.

In addition, the expression "at least one of a, b, and c" may be interpreted as "a", "b", "c", "a and b", "a and c", "b and c", or "a, b, and c".

Hereinafter, the disclosure will be described in detail with reference to the accompanying drawings.

FIG. 1 is a schematic view for describing an electronic system in which modular home appliances are stacked and collectively controlled according to an embodiment of the disclosure.

Referring to FIG. 1, an electronic system 10 includes a plurality of home appliances 100-1, 100-2, and 100-3.

Each of the plurality of home appliances 100-1, 100-2, and 100-3 may be a modular appliance attachable to or detachable from the other home appliance. Each of the home appliances 100-1, 100-2, and 100-3 may be supplied with power via an adaptor provided in each home appliance to execute functions of the home appliance independently. If the plurality of home appliances 100-1, 100-2, and 100-3 are stacked, the home appliances may execute functions of the home appliance collectively as a single home appliance, by supplying power to the stacked home appliances via an adaptor provided in the lowermost home appliance. That is, if the plurality of home appliances are stacked and collectively controlled, the plurality of stacked home appliances may execute an operation corresponding to a user command, when the user command is input.

For example, if the second home appliance 100-2 is arranged on an upper portion of the first home appliance 100-1 and connected to the first home appliance 100-1 supplied with power via the adaptor, the second home appliance 100-2 may be supplied with power from the first home appliance 100-1, and the first home appliance 100-1 and the second home appliance 100-2 may be collectively controlled. Then, if the third home appliance 100-3 is arranged on an upper portion of the second home appliance 100-2, the power supplied from the first home appliance 100-1 may be supplied to the third home appliance 100-3 via the second home appliance 100-2, and the first to third home appliances 100-1, 100-2, and 100-3 may be collectively controlled.

The home appliance 100 may be implemented as an air purifier as a modular appliance attachable to or detachable from another home appliance, but there is no limitation thereto, and the home appliance 100 may be implemented in various forms of a home appliance such as a humidifier, a speaker, and the like.

If the plurality of home appliances are stacked and collectively controlled, it is possible to improve performance of the home appliance by the number of stacked home appliances. For example, if the home appliance 100 is implemented as an air purifier and three air purifiers are stacked, the three air purifiers are collectively controlled by a user command as one appliance, and may execute an air purification function that is improved three times the function of a single air purifier.

According to an embodiment of the disclosure, if the plurality of home appliances are stacked, the plurality of home appliances may be collectively controlled as intended by a user, when the communication connection is established only between the plurality of stacked home appliances. Hereinafter, various embodiments of the disclosure regarding connection between the home appliances which are collectively controlled will be described in detail with reference to the drawings.

FIG. 2 is a block diagram showing a configuration of the home appliance according to an embodiment of the disclosure.

Figure 2A:
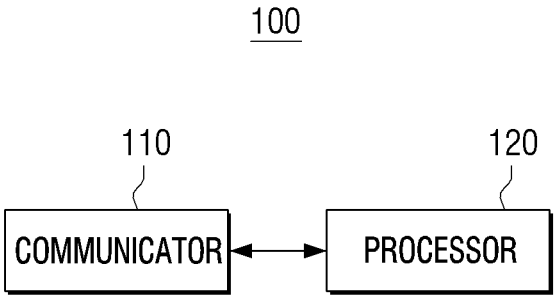
FIG. 2 is a block diagram showing a configuration of the home appliance according to an embodiment.

Referring to FIG. 2A, the home appliance 100 includes a communicator 110 and a processor 120.

The communicator 110 executes communication with an external home appliance adjacent to the home appliance 100.

The communicator 110 may execute wireless communication with an external home appliance by a communication system such as Bluetooth (BT), wireless fidelity (Wi-Fi), Zigbee, Infrared (IR), and the like, or may also execute communication with an external home appliance by various communication system such as serial interface, universal serial bus (USB), near field communication (NFC), and the like. In addition, the communicator 110 may execute wired communication with an external home appliance by a communication system with universal asynchronous receiver/transmitter (UART), serial peripheral interface (SPI), inter integrated circuit (I2C), and the like.

For example, if a predetermined event occurs, the communicator 110 may execute communication with an external home appliance by a predetermined communication system and may be associated therewith. The association may mean all of states in which the communication may be performed, such as an operation of initializing the communication between the home appliance 100 and an external home appliance, an operation of forming a network, an operation of executing pairing of the appliances, and the like. For example, appliance identification information of an external home appliance may be provided to the home appliance 100, and accordingly, a pairing process may be performed between both appliances. For example, if a predetermined event occurs in the home appliance 100 or an external home appliance, the home appliance 100 or an external home appliance may search for a neighboring appliance by a digital living network alliance (DLNA) and execute pairing with the searched appliance to be associated therewith.

The processor 120 may control general operations of the home appliance 100.

According to an embodiment, the processor 120 may be implemented as a digital signal processor (DSP), a microprocessor, or a time controller (TCON) processing digital signals. However, there is no limitation thereto, and the processor 120 may include one or more of a central processing unit (CPU), a microcontroller unit (MCU), a microprocessing unit (MPU), a controller, an application processor (AP), or a communication processor (CP), and an ARM processor or may be defined as the corresponding term. In addition, the processor 120 may be implemented as System on Chip (SoC) or large scale integration (LSI) including the processing algorithm or may be implemented in form of a Field Programmable gate array (FPGA).

If an event for communication connection to at least one external home appliance occurs, the processor 120 may receive a signal including identification information of the external home appliance from the at least one external home appliance via the communicator 110 for a predetermined period of time.

For example, if the Bluetooth communication system is used between the home appliance 100 and an external home appliance, the processor 120 may receive identification information of the external home appliance from the neighboring external home appliance, in order to perform Bluetooth pairing connection with a specific external home appliance. The identification information may include a product name, a product number, and a MAC address of the external home appliance, and type information indicating a type of the external home appliance, and particularly may include at least one of arrangement state information of the external home appliance.

The arrangement state information may be information including a top state indicating arrangement on an uppermost portion, a bottom state indicating arrangement on a lowermost portion, and a middle state indicating arrangement between the uppermost and the lowermost portions, among the plurality of stacked home appliances. If there is only one home appliance without being stacked, the arrangement state information of the home appliance may be "not applicable". If the number of the plurality of stacked home appliances is 4 or more, the number of home appliances having the arrangement state information indicating the middle state may be more than one.

An event for communication connection to the external home appliance may be at least one of an event of turning on the power of the home appliance 100 and an event in which the home appliance 100 is physically connected to at least one external home appliance.

The event in which the home appliance 100 is physically connected to the external home appliance may be, for example, an event in which, if a specific button is provided on an upper portion of the home appliance 100, a protrusion is provided on a lower portion of the external home appliance, and the external home appliance is arranged and stacked on the upper portion of the home appliance 100, the specific button is inevitably pressed by the protrusion provided on the lower portion of the external home appliance in order to safely fix the external home appliance to the home appliance 100. If the button provided on the home appliance 100 is pressed, a connection mode for executing the communication connection to the external home appliance may be executed.

For example, if the button is pressed, the processor 120 may execute the Bluetooth pairing mode and receive the identification information including the arrangement state information of the external home appliance from the external home appliance for a predetermined period of time, in order to perform the Bluetooth pairing with the specific external home appliance.

In addition, if the power of the home appliance 100 is turned on, the processor 120 may execute the Bluetooth pairing mode and receive the identification information including the arrangement state information of the external home appliance form the external home appliance for a predetermined period of time, in order to perform the Bluetooth pairing with the specific external home appliance.

The processor 120 may identify an external home appliance arranged adjacent to the home appliance 100 based on the received signal and execute communication connection to the identified external home appliance.

The processor 120 may identify an external home appliance arranged adjacent to the home appliance 100 in a predetermined arrangement state based on an intensity of the received signal. In addition, the processor 120 may identify an external home appliance arranged adjacent to the home appliance 100 in a predetermined arrangement state based on the arrangement state information.

The intensity of the received signal may be an average value of intensities of signals periodically received for a predetermined period of time. The processor 120 may calculate an average value of intensities of the signals periodically received for a predetermined period of time and determine the calculated average value as the intensity of the received signal of the external home appliance, since the intensity of the received signal may have an error due to interference or the like.

For example, if an intensity of a signal received from a first external home appliance is greater than an intensity of a signal received from a second external home appliance, the processor 120 may recognize that the first external home appliance is arranged relatively adjacent to the home appliance 100, compared to the second external home appliance.

The predetermined arrangement state herein may be at least one of a state arranged on the upper portion of the home appliance 100 and a state arranged on the lower portion of the home appliance 100.

The processor 120 may not execute the communication connection to an external home appliance that is not arranged on the upper portion or the lower portion of the home appliance 100 and is, for example, arranged in parallel to the home appliance. This is because the external home appliance that is not arranged on the upper portion or the lower portion of the home appliance 100 is not an appliance to be collectively controlled by a user.

When signals are received from the plurality of external home appliances and the intensity of the signal and the arrangement state information of each external home appliance are stored, the processor 120 may identify the external home appliance in the order from the greater intensity of the signal of the plurality of external home appliances and identify the arrangement state information of the external home appliance in the order from the greater intensity of the signal.

For example, the processor 120 may confirm the arrangement state information of the external home appliance having the greatest intensity of the signal, first, among the external home appliances stored in a storage (not shown). If the arrangement state information of the home appliance 100 indicates the top state and the arrangement state information of the external home appliance having the greatest intensity of the signal also indicates the top state, the processor 120 may identify that the corresponding external home appliance is not an appliance stacked on the home appliance 100, exclude the corresponding external home appliance from a target to be connected for communication, and identify arrangement state information of an external home appliance having a second greatest intensity of a signal. If the arrangement state information of the external home appliance having the second greatest intensity of the signal indicates the middle state, the processor 120 may execute the communication connection to the corresponding external home appliance.

As described above, if the communication connection is executed between the stacked home appliances and one appliance among the plurality of stacked home appliances, for example, a home appliance having the arrangement state information indicating the top state is, for example, identified as a master appliance controlling the plurality of stacked home appliances, the master appliance may receive a command input by a user, transmit the command to appliances connected to the master appliance for connection, and collectively control the plurality of stacked home appliances.

If the external home appliance is identified as the same type as the home appliance 100 based on the type information of the external home appliance, the processor 120 may execute the communication connection to the identified external home appliance based on the identification information.

For example, if the type information of the home appliance 100 indicates an air purifier and the type information of the external home appliance indicates an air purifier, the processor 120 may execute the communication with the external home appliance by identifying the arrangement state information included in the identification information of the external home appliance.

According to an embodiment of the disclosure, the processor 120 may transmit a pairing request signal to the plurality of external home appliances according to an event for communication connection to the external home appliances. The pairing request signal may include the identification signal of the home appliance 100. The identification information may include a product name, a product number, and a MAC address of the home appliance, and particularly, type information indicating a type of the home appliance 100. That is, the processor 120 may transmit the pairing request signal including the type information of the home appliance 100 to the plurality of external home appliances. For example, the type information of the home appliance 100 may be an air purifier but is not limited thereto. The processor 120 may periodically transmit the pairing request signal to the external home appliance for a predetermined period of time.

The processor 120 may receive a pairing response signal including arrangement state information of each external home appliance from the plurality of external home appliances for a predetermined period of time. The processor 120 may store an intensity and the arrangement state information of the pairing response signal received from the plurality of external home appliances in a storage (not shown). The pairing response signal may include the identification information of the external home appliance. The identification information may include a product name, a product number, and a MAC address of the external home appliance, and particularly, arrangement state information of the external home appliance and type information indicating a type of the external home appliance. That is, the processor 120 may receive the pairing response signal including the arrangement state information and the type information of each external home appliance from the plurality of external home appliances. In addition, the processor 120 may receive not only the arrangement state information and the type information, but also information indicating that the external home appliance is a modular appliance which is able to be collectively controlled, from the plurality of external home appliances.

The processor 120 may identify the external home appliance to be connected for communication based on the intensity of the received signal. The processor 120 may identify the external home appliance in the order from the greater intensity of the stored signal of the external home appliance, and identify the arrangement state information of the external home appliance in the order of greater intensity of signal.

The processor 120 may determine whether or not the external home appliance is in the predetermined arrangement state with respect to the home appliance 100 based on the arrangement state information of the home appliance 100 and the identified arrangement state information of the external home appliance. The processor 120 may execute the communication connection to the external home appliance having the greatest intensity of the received signal among the identified external home appliances in the predetermined arrangement state with respect to the home appliance 100.

For example, if the processor 120 identifies the external home appliance having the greatest intensity of the received signal, when the arrangement state information of the home appliance 100 indicates the top state and the arrangement state information of the external home appliance having the greatest intensity of the signal indicates the middle state, the processor 120 may identify that the external home appliance having the greatest intensity of the signal is arranged on the lower portion of the home appliance 100 and execute the communication connection to the corresponding external home appliance. However, when the arrangement state information of the home appliance 100 indicates the top state and the arrangement state information of the external home appliance having the greatest intensity of the signal indicates the top state, the processor 120 may identify that the corresponding external home appliance is not arranged on the upper portion or the lower portion of the home appliance and may not execute the communication connection to the corresponding external home appliance.

The communication connection using the Bluetooth communication system may include pairing that means the connection between two appliances and bonding that is storing pairing history. If the pairing is performed between two appliances first and then the pairing is performed between the two appliances again in the future, it is possible to perform the pairing more rapidly by using the previous history through the bonding. The detailed description thereof will be omitted, since the pairing and the bonding are well-known technologies.

According to an embodiment of the disclosure, the processor 120 may execute only the pairing with the identified external home appliance, each time the event for the communication connection to the external home appliance occurs, and may not execute the bonding. That is, the processor 120 may not store the previous pairing history and may identify the external home appliance to be connected to the home appliance 100 for communication each time the event for communication connection occurs. By not executing the bonding, the processor 120 may identify the external home appliance currently arranged in the predetermined arrangement state with respect to the home appliance 100, although the arrangement of some home appliances of the plurality of stacked home appliances previously is changed. For example, it is assumed that the first and second home appliances among the first to fourth home appliances are stacked as a first group and the third and fourth home appliances are stacked as a second group, separately from the first and second home appliances. The first and second home appliances may be paired with each other so that the first and second home appliances are collectively controlled, and the third and fourth home appliances may be paired with each other so that the third and fourth home appliances are collectively controlled. In the future, if the positions of the first and third home appliances are interchanged so that the second and third home appliances are stacked, and the first and fourth home appliances are stacked separately, the second and third home appliances may be paired with each other and the first and fourth home appliances may be paired with each other, when the event for communication connection between home appliances occurs, since the bonding is not executed.

However, assuming that the bonding is executed, if the positions of the first and third home appliances are interchanged so that the second and third home appliances are stacked, and the first and fourth home appliances are stacked separately from this, the first and second home appliances may be paired with each other and the third and fourth home appliances may be paired with each other based on the previous pairing connection history. However, the group control may not be performed as intended by a user, since each group for collectively controlling by a user is the group of the stacked second and third home appliances and the group of the first and fourth home appliances.

Accordingly, the home appliances may be collectively controlled for each group intended by a user according to the arrangement states of the home appliances by excluding the bonding in the Bluetooth pairing process. However, this is merely an embodiment, and the bonding may be executed in the pairing connection process.

According to an embodiment of the disclosure, the identification information received from the external home appliance may include ready state information indicating a connectable state to another home appliance. If the event for communication connection occurs, the external home appliance may also periodically transmit the identification information of the external home appliance to neighboring home appliances for a predetermined period of time. When a connection request is received from another appliance within a predetermined period of time, the external home appliance may refuse this, since the external home appliance needs to identify the home appliance to be connected thereto for a predetermined period of time. When the predetermined period of time has passed, the external home appliance may transmit the identification information including the ready state information indicating that the external home appliance is in a connectable state to another home appliance to neighboring home appliances. When the ready state information is included in at least one signal of the signals periodically received from the external home appliance identified as the appliance to be connected for communication, the processor 120 may execute the communication connection to the corresponding external home appliance.

Figure 2B:
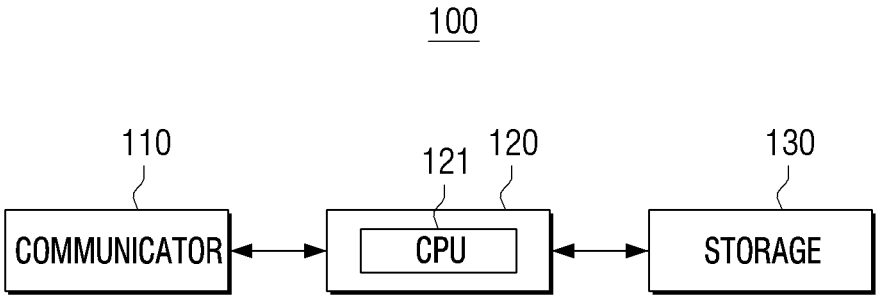

FIG. 2B is a view showing an example of a specific configuration of the home appliance of FIG. 2B.

Referring to FIG. 2B, the home appliance 100 includes the communicator 110, the processor 120, and a storage 130.

The detailed description will be omitted regarding components shown in FIG. 2B overlapped with the components shown in FIG. 2A.

The processor 120 may include a CPU 121, a ROM (or a non-volatile memory) storing a control program for controlling the home appliance 100, and a RAM (or a volatile memory) storing data input from the outside of the home appliance 100 or used as a storage area corresponding to various operations executed by the home appliance 100.

If a predetermined event occurs, the processor 120 may executes an operating system (OS), programs, and various applications stored in the storage 130. The processor 120 may be a single-core processor, a dual-core processor, a triple-core processor, a quad-core processor, or other multi-core processors.

The CPU 121 executes booting using the 0/S stored in the storage 130 by accessing the storage 130. In addition, various operations are performed by using various programs, contents, and data stored in the storage 130.

If the event for communication connection to at least one external home appliance occurs, the processor 120 may receive a signal including the arrangement state information of the external home appliance from the at least one external home appliance via the communicator 110 for a predetermined period of time.

For example, if the Bluetooth communication system is used between the home appliance 100 and the external home appliance, the processor 120 may receive the identification information of the neighboring external home appliances from the external home appliances for the Bluetooth pairing connection with a specific external home appliance. The identification information may include a product name, a product number, and a MAC address of the external home appliance, and type information indicating a type of the external home appliance, and particularly may include arrangement state information of the external home appliance.

The storage 130 may store data, programs, or applications for operating or controlling the home appliance 100. The storage 130 may store a control program for controlling the home appliance 100 and the processor 120, an applications, databases, or pieces of related data initially provided from a manufacturer or downloaded from outside. For example, the storage 130 may store a program for providing a UI for multi-channel setting according to embodiments of the disclosure and for executing operations related to the UI.

In particular, the storage 130 may store intensities of signals received from the external home appliances and identification information of the external home appliances including the arrangement state information and the type information. The arrangement state information may be information including a top state indicating arrangement on an uppermost portion, a bottom state indicating arrangement on a lowermost portion, and a middle state indicating arrangement between the uppermost and the lowermost portions, among the plurality of stacked home appliances. For example, the arrangement state information of the home appliance that is disposed on the uppermost portion among the three stacked home appliances indicates the top state.

The storage 130 may be implemented as an internal memory such as a ROM, a RAM, or the like included in the processor 120 or may be implemented as a memory separated from the processor 120. In such a case, the storage 130 may be implemented in a form of a memory embedded in the home appliance 100 or implemented in a form of a memory detachable from the home appliance 100 according to data storage purpose. For example, data for operating the home appliance 100 may be stored in a memory embedded in the home appliance 100, and data for an extended function of the home appliance 100 may be stored in a memory detachable from the home appliance 100. The memory embedded in the home appliance 100 may be implemented in a form of a non-volatile memory, a volatile memory, a hard disk drive (HDD), or a solid state drive (SSD).

Figure 3:
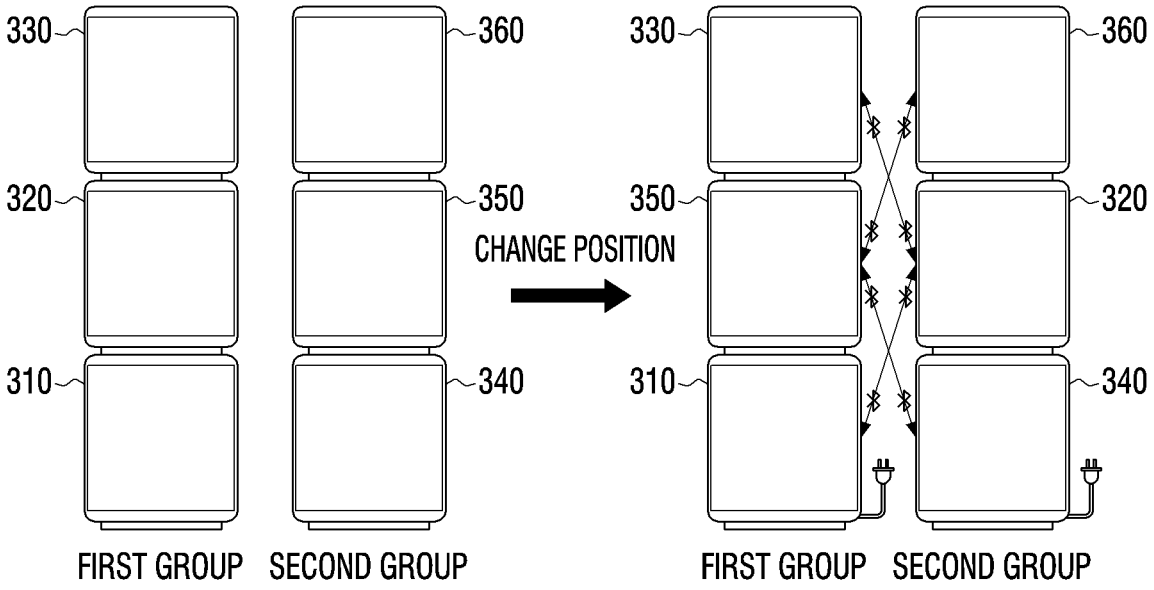
FIG. 3 is a view for describing a process of executing communication connection in a group in which the plurality of home appliances are stacked according to an embodiment.

FIG. 3 is a view for describing a process of executing communication connection in a group in which the plurality of home appliances are stacked according to an embodiment of the disclosure.

Referring to FIG. 3, the Bluetooth communication system may be used in each group in which the plurality of home appliances are stacked. The communication connection using the Bluetooth communication system may include pairing that means the connection between two appliances and bonding that is storing pairing history. If the pairing is performed between two appliances first and then the pairing is performed between the two appliances again in the future, it is possible to perform the pairing more rapidly by using the previous history through the bonding.

According to an embodiment of the disclosure, the home appliance 100 may execute only the pairing with the identified home appliance, each time the event for the communication connection between the home appliances occurs, and may not execute the bonding. That is, the home appliance 100 may not store the previous pairing history and may identify another home appliance to be connected to the home appliance 100 for communication each time the event for communication connection occurs.

Referring to FIG. 3, first to third home appliances 310, 320, and 330 are stacked on each other as a first group, and fourth to sixth home appliances 340, 350, and 360 are stacked on each other as a second group, separately from the first group. The first to third home appliances 310, 320, and 330 may be paired with each other so that the first group is collectively controlled, and the fourth to sixth home appliances 340, 350, and 360 may be paired with each other so that the second group is collectively controlled.

It is assumed that the positions of the second home appliance 320 and the fifth home appliance 350 are interchanged in the future. Assuming that not only the pairing, but also the bonding is performed between the home appliances in the group, a problem such that the first home appliance 310 performs the pairing with the second home appliance 320 in the other group and the third home appliance 330 also performs the pairing with the second home appliance 320 in the other group based on the previous pairing history may occur. Accordingly, each group of the stacked home appliances may not be collectively controlled.

However, if the bonding is not performed and a target to be paired with is searched for each time the event for communication connection between the home appliance and the other home appliance occurs, the first home appliance 310 and the fifth home appliance 350 are connected to each other for communication and the fifth home appliance 350 and the third home appliance 330 are connected to each other for communication, although the positions of the second home appliance 320 and the fifth home appliance 350 are interchanged. Accordingly, the first home appliance 310, the fifth home appliance 350, and the third home appliance 330 stacked on each other may be collectively controlled as one group. In addition, the fourth home appliance 340 and the second home appliance 320 may be connected to each other for communication and the second home appliance 320 and the sixth home appliance 360 may be connected to each other for communication. Accordingly, the fourth home appliance 340, the second home appliance 320, and the sixth home appliance 360 stacked on each other may be collectively controlled as one group.

Thus, by not executing the bonding in the pairing process, each group in which the home appliances are physically stacked on each other may be collectively controlled, since the communication connection is executed based on the arranged structure of home appliances.

Figure 4:
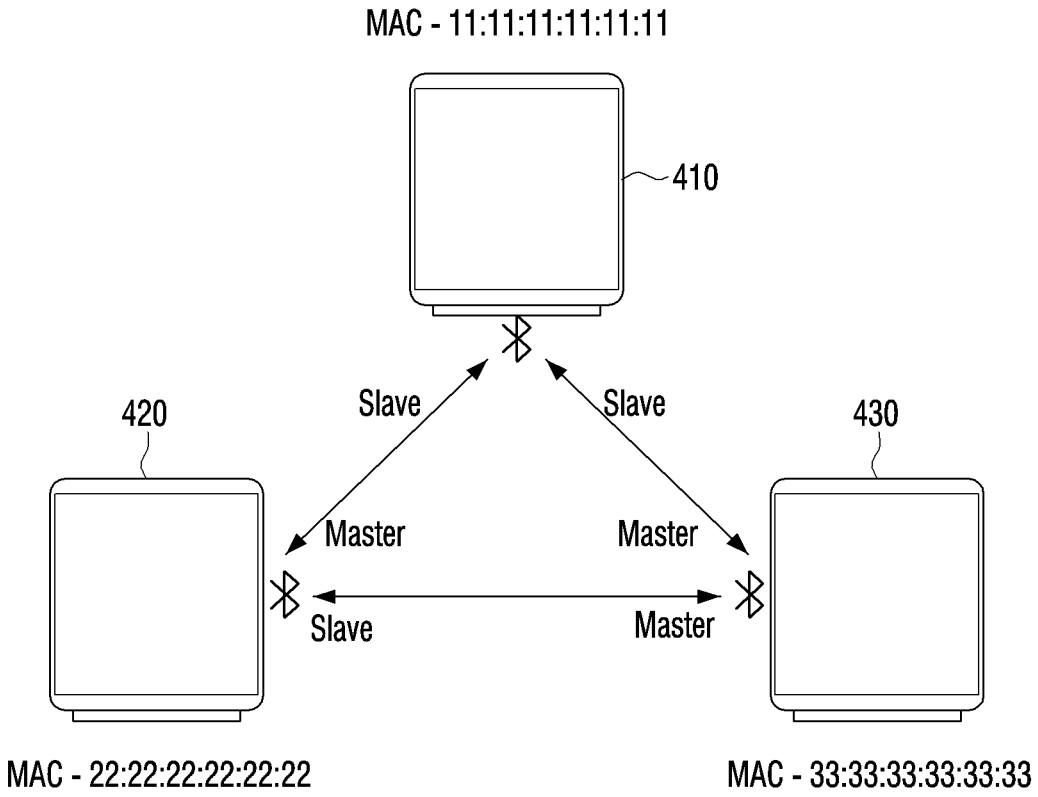
FIG. 4 is a view for describing a method for determining a master appliance between two appliances connected to each other for communication according to an embodiment.

FIG. 4 is a view for describing a method for determining a master appliance between two appliances connected to each other for communication according to an embodiment of the disclosure.

Referring to FIG. 4, first to third home appliances 410, 420, and 430 are arranged to be stacked as three layers, but the structure thereof is described as a triangular structure, for convenience.

If the event for the communication connection occurs, the first to third home appliances 410, 420, and 430 stacked on each other may broadcast advertising signals including the identification information of the home appliances for a predetermined period of time and scan the advertising signals broadcasted from the other home appliances, at the same time.

The communication connection may be executed between the first to third home appliances 410, 420, and 430, for example, by the Bluetooth communication system. In the Bluetooth communication system, the home appliances are divided into master appliances and slave appliances and the pairing connection may be executed, when the master appliance broadcasts the advertising signal and the slave appliance scans the advertising signal broadcasted by the master appliance.

According to an embodiment of the disclosure, the plurality of home appliances stacked on each other and collectively controlled as one group may be generally the home appliances of the same type. Therefore, it is necessary to provide standard to divide the home appliances connected to each other for communication into the master appliance and the slave appliance.

According to an embodiment, the home appliances may be divided into the master appliance and the slave appliance based on the MAC address included in the advertising signal of each home appliance. The home appliance with the MAC address represented by a greater number may be the master appliance. For example, if a MAC address of the first home appliance 410 is 11:11:11:11:11:11 and a MAC address of the second home appliance 420 is 22:22:22:22:22:22, the second home appliance 420 may be a master appliance and the first home appliance 410 may be a slave appliance, since the number of the MAC address of the second home appliance 420 is greater than the number of the MAC address of the first home appliance 410. Accordingly, the second home appliance 420 may transmit a pairing request signal to the first home appliance 410 and the first home appliance 410 may execute the pairing connection in response to this.

In addition, the third home appliance 430 may be a master appliance and the second home appliance 420 may be a slave appliance, since the number of the MAC address of the second home appliance 420, 22:22:22:22:22:22, is smaller than the number of the MAC address of the third home appliance 430, 33:33:33:33:33:33. Accordingly, the third home appliance 430 may transmit a pairing request signal to the second home appliance 420 and the second home appliance 420 may execute the pairing connection in response to this. The same applies to the first home appliance 410 and the third home appliance 430. The third home appliance 430 identified as the master appliance may transmit a pairing request signal to the first home appliance 410 identified as a slave appliance and the first home appliance 410 may execute the pairing connection based on the system described above, in response to this.

However, the dividing into the master appliance and the slave appliance herein is merely for dividing the appliances for the Bluetooth connection, and the master appliance herein does not mean a master appliance for collectively controlling the group of the plurality of stacked home appliances. For example, the second home appliance 420 may be the master appliance in the Bluetooth connection process to the first home appliance 410, but the master appliance for collectively controlling the first home appliance to the third home appliance 410, 420, and 430 may be, for example, the third home appliance 430 arranged on the uppermost portion.

Figure 5:
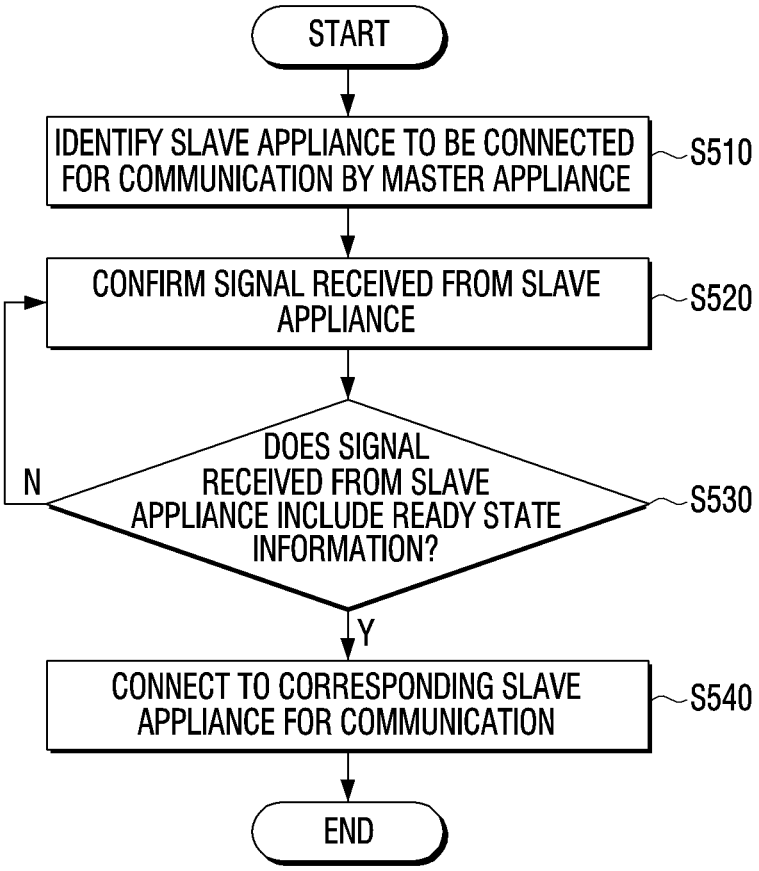
FIG. 5 is a view for describing a ready state indicating a connectable state to another appliance according to an embodiment.

FIG. 5 is a view for describing a ready state indicating a connectable state to another appliance according to an embodiment of the disclosure.

As described with reference to FIG. 4, the home appliances may be divided into a master appliance and a slave appliance for communication connection between both appliances, and the slave appliance to be connected to the master appliance for communication may be identified for a predetermined period of time (S510). The master appliance may confirm the advertising signal received from the slave appliance (S520). Specifically, the master appliance may determine whether or not the advertising signal received from the slave appliance includes the ready state information (S530). The ready state information may be information indicating that the slave appliance is ready to be connected to the master appliance for communication. Even in a case where the pairing mode is executed at the same time in each home appliance included in one group due to the event for communication connection occurs, time points when the home appliances enter the pairing mode may be substantially different from each other. Accordingly, time points when predetermined periods of time for the home appliances have elapsed after entering the pairing mode may be different from each other.

That is, the master appliance may transmit a communication connection request signal to the slave appliance after the elapse of the predetermined period of time, but the predetermined period of time for the slave appliance may have not elapsed yet. If the communication connection request signal is received from the master appliance within the predetermined period of time, the slave appliance may refuse this, since the period of time for searching for the optimal appliance to be connected for communication has not elapsed yet. If the predetermined period of time has elapsed, the slave appliance may include the ready state information indicating that the slave appliance is ready to be connected to the master appliance for communication in the advertising signal.

If the ready state information is included in the advertising signal broadcasted by the slave appliance (S530-Y), the master appliance may transmit the communication connection request signal to the corresponding slave appliance to execute the communication connection (S540).

If the ready state information is not included in the advertising signal broadcasted by the slave appliance (S530-N), the master appliance may confirm the advertising signal received from the slave appliance.

Figure 6:
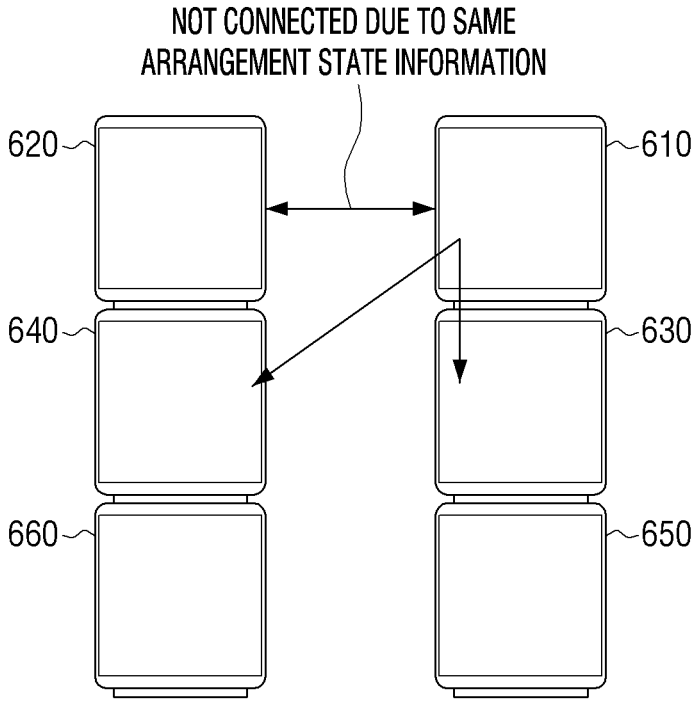
FIG. 6 is a view for describing a process of identifying a home appliance to be connected for communication based on an intensity of a signal and arrangement state information according to an embodiment.

FIG. 6 is a view for describing a process of identifying the home appliance to be connected for communication based on the intensity of the signal and the arrangement state information according to an embodiment of the disclosure.

The plurality of stacked home appliances should be collectively controlled by executing the communication connection only between the plurality of stacked home appliances, but the collective control may not be executed between the home appliances intended by a user, if the communication connection is executed between the other home appliances not stacked on each other. However, according to the embodiments of the disclosure, the plurality of stacked home appliances may be collectively controlled by executing the communication connection only between the stacked home appliances.

A first home appliance 610 may store intensities of signals and arrangement state information of other home appliances received from the other home appliances for a predetermined period of time, and may identify a home appliance to be connected for communication based on the stored intensities of the signals and the arrangement state information of the other home appliances.

The arrangement state information may be information including a top state indicating arrangement on an uppermost portion, a bottom state indicating arrangement on a lowermost portion, and a middle state indicating arrangement between the uppermost and the lowermost portions, among the plurality of stacked home appliances. For example, the arrangement state information of first and second home appliances 610 and 620 indicates the top state, and the arrangement state information of third and fourth home appliances 630 and 640 indicates the middle state.

The first home appliance 610 may receive a signal including identification information of each home appliance from the second to sixth home appliances 620 to 660. Although the second home appliance 620 is arranged close to the first home appliance 610 and the intensity of the signal received from the second home appliance 620 is great, the first home appliance 610 may not execute the communication connection to the second home appliance 620 having the same arrangement state information as that of the first home appliance 610, since the arrangement state information of the second home appliance 620 indicates the top state.

The arrangement state information of each appliance received by the first home appliance 610 from the third home appliance 630 and the fourth home appliance 640 indicates the middle state, the third home appliance 630 and the fourth home appliance 640 are appliances to be stacked on the first home appliance 610 for communication. However, the intensities of the signals received by the first home appliance 610 from the third home appliance 630 and the fourth home appliance 640 may be different from each other. A distance between the third home appliance 630 and the first home appliance 610 spaced apart from each other may be comparatively shorter than a distance between the fourth home appliance 640 and the first home appliance 610 spaced apart from each other, since the third home appliance 630 is arranged on the upper portion of the first home appliance 610. The shorter the distance, the greater the intensity of the received signal, and accordingly, the intensity of the signal received by the first home appliance 610 from the third home appliance 630 may be greater than the intensity of the signal received by the first home appliance 610 from the fourth home appliance 640. Therefore, the first home appliance 610 may execute the communication connection to the third home appliance 630 having a comparatively greater intensity of the received signal.

As described above, the home appliance executes the communication connection to another home appliance identified based on the intensity of the signal and the arrangement state information received, and accordingly, the communication connection to another home appliance that is not stacked on the corresponding home appliance may not be executed.

Figure 7:
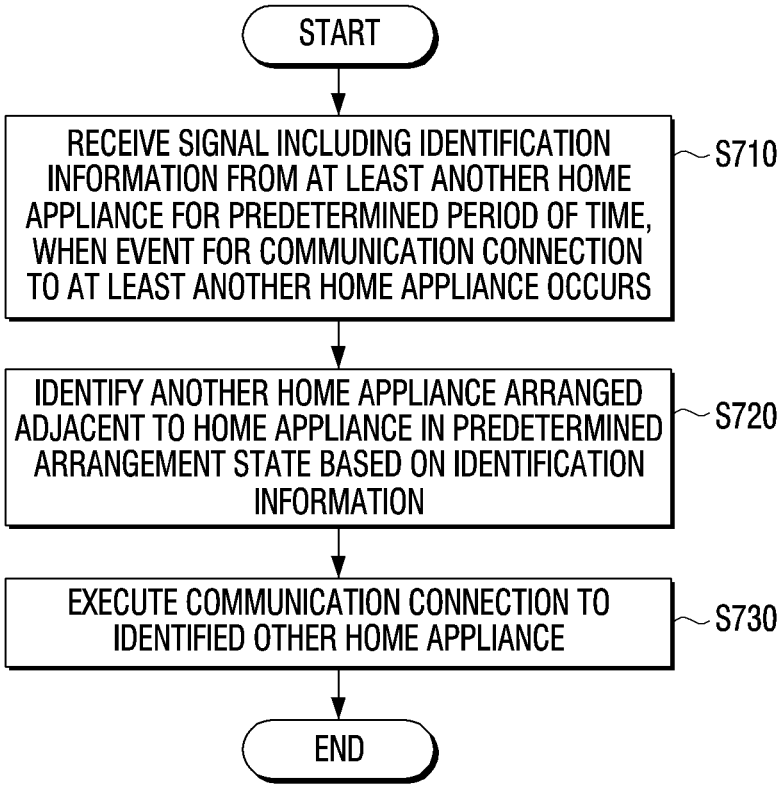
FIG. 7 is a flowchart for describing a method for controlling the home appliance according to an embodiment.

FIG. 7 is a flowchart for describing a method for controlling the home appliance according to an embodiment of the disclosure.

If the event for communication connection to at least another home appliance occurs, the home appliance 100 may receive a signal including identification information from the at least another home appliance for a predetermined period of time (S710). The event for communication connection may be at least one of an event of turning on the power of the home appliance 100 and an event in which the home appliance 100 is physically connected to at least one external home appliance.

The home appliance 100 may transmit a pairing request signal including the type information of the home appliance to a plurality of other home appliances according to the event for the communication connection, and may receive pairing response signals including the arrangement state information and the type information of each home appliance from the plurality of other home appliances for a predetermined period of time. The type information herein may be information indicating the type of the home appliance and may indicate, for example, an air purifier, but is not limited thereto.

The home appliance 100 may store the intensity of the pairing response signal and arrangement state information received from each of the plurality of other home appliances. The intensity of the received signal may be an average value of intensities of signals periodically received for a predetermined period of time.

The home appliance 100 may identify another home appliance arranged adjacent to the home appliance in a predetermined arrangement state based on the identification information (S720). The predetermined arrangement state herein may be at least one of a state arranged on the upper portion of the home appliance 100 and a state arranged on the lower portion of the home appliance 100.

The home appliance 100 may identify another home appliance to be connected for communication based on the intensity of the stored signal and determine whether or not the other home appliance is in a predetermined arrangement state with respect to the home appliance 100 based on the arrangement state information of the home appliance 100 and the arrangement state information of the identified other home appliance.

The home appliance 100 may execute the communication connection to the identified other home appliance (S730).

The detailed description regarding the specific operations of each step will be omitted, since it has been described above.

The embodiments described above may be implemented in a recording medium readable by a computer or a similar device using software, hardware, or a combination thereof. In some cases, the embodiments described in this specification may be implemented as a processor itself. According to the implementation in terms of software, the embodiments such as procedures and functions described in this specification may be implemented as software modules. Each of the software modules may execute one or more functions and operations described in this specification.

Computer instructions for executing processing operations according to the embodiments of the disclosure descried above may be stored in a non-transitory computer-readable medium. When the computer instructions stored in such a non-transitory computer-readable medium are executed by the processor, the computer instructions may enable a specific machine to execute the processing operations according to the embodiments described above.

The non-transitory computer-readable medium is not a medium storing data for a short period of time such as a register, a cache, or a memory, but means a medium that semi-permanently stores data and is readable by a machine. Specific examples of the non-transitory computer-readable medium may include a CD, a DVD, a hard disk, a Blu-ray disc, a USB, a memory card, and a ROM.

Hereinabove, the preferred embodiments of the disclosure have been shown and described, but the disclosure is not limited to specific embodiments described above, various modifications may be made by those skilled in the art without departing from the gist of the disclosure claimed in the claims, and such modifications may not be individually understood from the technical spirit or the prospect of the disclosure.

What is claimed is:

1. A home appliance comprising:

a communicator comprising circuitry; and a processor configured to:

based on an event for communication connection to at least one external home appliance occurring, receive a signal including identification information of the at least one external home appliance from the external home appliance via the communicator for a predetermined period of time, identify an external home appliance arranged adjacent to the home appliance based on the received signal, and execute communication connection to the identified external home appliance, wherein the processor is further configured to identify an external home appliance arranged adjacent to the home appliance in a predetermined arrangement state based on an intensity of the received signal.

2. The home appliance according to claim 1, wherein the identification information comprises type information of an external home appliance, and wherein the processor is configured to, based on the external home appliance being identified as the same type as the home appliance based on the type information of the external home appliance, execute the communication connection to the identified external home appliance based on the identification information.

3. The home appliance according to claim 1, wherein the identification information comprises arrangement state information of the external home appliance, and wherein the processor is configured to identify an external home appliance arranged adjacent to the home appliance in a predetermined arrangement state based on the arrangement state information.

4. The home appliance according to claim 1, wherein the identification information comprises at least one of a product name, a product number, and a MAC address, arrangement state information of the external home appliance, and type information of the external home appliance.

5. The home appliance according to claim 1, further comprising:

a storage, wherein the processor is further configured to:

transmit pairing request signals to a plurality of external home appliances according to the event, receive a pairing response signal including arrangement state information of each external home appliance from the plurality of external home appliances for a predetermined period of time, and store intensities of the pairing response signals and arrangement state information received form the plurality of external home appliances in the storage.

6. The home appliance according to claim 5, wherein the processor is further configured to:

transmit pairing request signals including type information of the home appliance to the plurality of external home appliances, and receive pairing response signals including arrangement state information and type information of each external home appliance from the plurality of external home appliances.

7. The home appliance according to claim 1, wherein the predetermined arrangement state is at least one of a state arranged on an upper portion of the home appliance and a state arranged on a lower portion of the home appliance, and wherein the processor is further configured to:

identify an external home appliance to be connected for communication based on an intensity of the received signal, and determine whether or not the external home appliance is in the predetermined arrangement state with respect to the home appliance based on arrangement state information of the home appliance and arrangement state information of the identified external home appliance.

8. The home appliance according to claim 6, wherein the arrangement state information is information including a top state indicating arrangement on an uppermost portion, a bottom state indicating arrangement on a lowermost portion, and a middle state indicating arrangement between the uppermost and the lowermost portions, among a plurality of stacked home appliances.

9. The home appliance according to claim 1, wherein the home appliance and the external home appliance are air purifiers.

10. The home appliance according to claim 1, wherein the intensity of the received signal is an average value of intensities of signals periodically received for the predetermined period of time.

11. The home appliance according to claim 1, wherein the event for communication connection is at least one of an event of turning on power of the home appliance and an event in which the home appliance is physically connected to at least one external home appliance.

12. A method for controlling a home appliance, comprising:

based on an event for communication connection to at least one external home appliance occurring, receiving a signal including identification information of the at least one external home appliance from the external home appliance for a predetermined period of time;

identifying an external home appliance arranged adjacent to the home appliance based on the received signal; and executing communication connection to the identified external home appliance, wherein the identifying comprises identifying an external home appliance arranged adjacent to the home appliance in a predetermined arrangement state based on an intensity of the received signal.

13. The method according to claim 12, wherein the identification information comprises type information of an external home appliance, and wherein the executing communication connection comprises, based on the external home appliance being identified as the same type as the home appliance based on the type information of the external home appliance, executing the communication connection to the identified external home appliance based on the identification information.

* * * * *